United States Patent [19]

Vollman

[11] 4,322,048

[45] Mar. 30, 1982

[54] BAG HOLDING AND SUPPORTING APPARATUS

[75] Inventor: Charles K. Vollman, Elgin, Ill.

[73] Assignee: Co-Poly-Ex Corporation, Elgin, Ill.

[21] Appl. No.: 179,070

[22] Filed: Aug. 18, 1980

[51] Int. Cl.[3] ..... A63B 55/04

[52] U.S. Cl. ..... 248/97; 248/101

[58] Field of Search ..... 248/95, 97, 99, 101, 248/100; 150/51

[56] References Cited

U.S. PATENT DOCUMENTS

| | | | |
|---|---|---|---|
| 48,083 | 6/1865 | Morian | 248/97 |
| 310,101 | 12/1884 | Wagner | 248/97 X |
| 334,482 | 1/1886 | Steenrod | 248/97 |
| 646,762 | 4/1900 | Reser et al. | 248/101 X |
| 1,045,281 | 11/1912 | Gunderson | 248/101 |
| 1,149,446 | 8/1915 | Hotchkiss | 248/101 |
| 2,762,100 | 9/1956 | Wallney | 24/259 R X |
| 3,160,119 | 12/1964 | Bowe et al. | 150/51 X |
| 3,599,918 | 8/1971 | Patchett | 24/259 R X |
| 3,757,990 | 9/1973 | Buth | 248/101 X |
| 3,796,402 | 3/1974 | Trotta | 248/101 X |

FOREIGN PATENT DOCUMENTS

| | | | |
|---|---|---|---|
| 505479 | 12/1954 | Italy | 248/295.1 |
| 455847 | 5/1936 | United Kingdom | 248/101 |

*Primary Examiner*—J. Franklin Foss

*Attorney, Agent, or Firm*—Lockwood, Dewey, Alex & Cummings

[57] ABSTRACT

Bag holding and supporting apparatus for holding and supporting a bag, especially of the flexible-walled plastic-film type, in an open and upright position for more convenient and efficient placement of articles or merchandise in the bag. The holding and supporting apparatus is situated adjacent a generally horizontal surface on which the bottom of the bag rests and the bag holder resiliently engages an upper sidewall portion of the bag near the top open end. An upright member has a base at the lower end for securing the apparatus relative to the horizontal surface. The upright member includes two portions in telescoping relationship to accommodate different height bags. A supporting head is attached to the upper end of the upright member and is of modified R-shape in cross section with opposing sides of the R-shape adapted to resiliently engage the sidewall of the bag for ease of insertion and removal of the bag from the head.

2 Claims, 6 Drawing Figures

BAG HOLDING AND SUPPORTING APPARATUS

BACKGROUND OF THE INVENTION

This invention relates in general to apparatus for holding and supporting bags in an open and upright position and is more particularly concerned with such apparatus including telescoping upright members for accommodating bags of different heights, a base portion secured to a lower telescoping member to mount the apparatus in relation to a horizontally disposed surface on which the bottom of the bag rests, and a support head on the upper telescoping member adapted to resiliently engage an upper sidewall portion of the bag in an open and upright position for filling of same with groceries, merchandise or the like.

Paper bags, especially for containing groceries, are usually constructed and fabricated to assume a self-standing upright position when the bag is opened from its manufactured folded condition. The ability of the common paper grocery bag to assume the upright position is obtained by the use of paper exhibiting the appropriate degree of stiffness, or use of multiple layers or gussets, which supply the sidewalls of the bag with sufficient rigidity in conjunction with creases or fold lines which define a suitable self-standing shape for the bag. These paper grocery bags are also provided with a generally planar bottom panel for resting upon a planar surface, such as a checkout counter in the store, which further enhances the ability to freely stand in an open and upright position. It is this ability of the common grocery bag to freely stand in an open and upright position which accounts in large part for its popularity since a store checkout clerk can use both hands in filling the bag with groceries or other merchandise. This affords greater convenience for the checkout clerk and promotes greater efficiency in store checkout operations.

For a number of years, plastic bags have been potentially price competitive with correspondingly sized paper bags. It is of course possible to provide plastic bags with equivalent or greater strength than corresponding paper bags by controlling formation of the thickness of the plastic film before the film undergoes cutting, heat sealing, or other operations to create a plastic bag therefrom. However, even in view of the large number of bags used in grocery checkout operations, plastic bags have not gained significant popularity in these markets. This is apparently due to the fact that, while plastic bags can be made sufficiently strong with thin plastic films in the vicinity of one to two mils, such thin films also contribute to a high degree of flexibility such that the checkout clerk must ordinarily hold the mouth or open end of a plastic bag open with one hand to be able to fill the plastic bag. It is also known to the prior art to form handles or the like into the open end of plastic bags for convenience of the shopper in carrying the bag after it is filled. However, such additional features have not offset the inconvenience and lack of efficiency in filling flexible plastic bags.

Accordingly, it is a primary object of the present invention to provide bag holding and supporting apparatus capable of holding and supporting a flexible thin film plastic bag in an open and upright position while the bottom of the bag is resting upon a generally horizontal surface.

It is another object of the present invention to provide bag holding and supporting apparatus having a supporting head to resiliently engage a portion of the sidewall of the bag near the top open end thereof in a manner which promotes convenient and efficient insertion and removal of the bag from the supporting head.

Another object is to provide a telescoping upright member in the bag holding and supporting apparatus to accomodate bags of different heights.

A further object of the present invention is to provide bag holding and supporting apparatus which is simple and easy to use and is inexpensive to manufacture.

SUMMARY OF THE INVENTION

The present invention is directed to bag holding and supporting apparatus for holding and supporting a bag, especially a bag made from thin and flexible plastic film materials, in an open and upright position for convenience in filling the bag with groceries or other merchandise, as at a store checkout counter. The apparatus includes upright means disposed in a generally vertical orientation defining an upper and a lower end thereof, a base attached to the lower end of the upright means and adapted for securing the apparatus in fixed relation to a generally horizontal surface upon which a bottom portion of the bag rests, and bag engaging means attached to an upper end of the upright means and adapted for engaging a sidewall of the bag to hold and support the bag in the upright position. Preferably the upright means includes two portions, a lower portion attached to the base and an upper portion attached to the supporting head, with the two portions in telescoping relationship, as by one portion having rolled transverse edges defining a channel in which the other portion may slidably telescope. The supporting head is preferably of a modified R-shape in cross-section, with opposing sides of the R-shape resiliently engaging each other to resiliently and frictionally support a sidewall of the bag therebetween. The unattached leg of the R-shape preferably points outwardly away from the upper end of the upright means to define an opening therebetween which converges toward the resilient engagement area of the supporting head for further convenience in inserting or removing the bag from the support head merely by slidably moving the bag sidewall into or out of the head.

BRIEF DESCRIPTION OF THE DRAWINGS

The features of the present invention, which are believed to be novel, are set forth with particularity in the appended claims. The invention, together with the further advantages thereof, can best be understood by reference to the following description taken in conjunction with the following drawings, and the several figures in which like reference numerals identify like elements, and in which:

DESCRIPTION OF THE PREFERRED EMBODIMENTS

Figure 1:
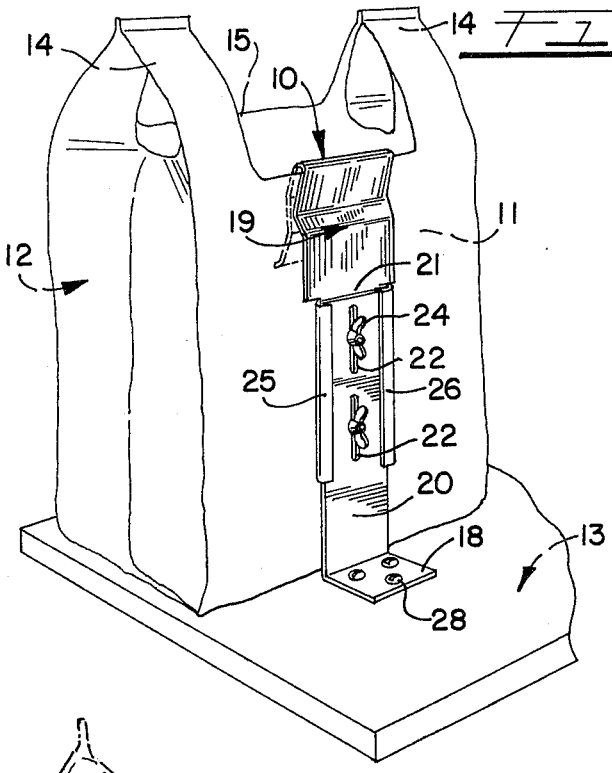
FIG. 1 is a perspective view, taken substantially in elevation, of the bag holding and supporting apparatus of the present invention mounted on a substantially horizontal surface and rising vertically therefrom to support and hold a bag in a generally upright and open condition.

Referring first to FIG. 1, there is illustrated a bag support and holder, generally designated 10, for holding and supporting a sidewall 11 of a bag 12 in an open and upright condition, with a bottom surface of the bag 12 resting upon a generally horizontally disposed surface 13 such as forms part of a checkout counter (not shown), or the like, in a store. While the present invention is particularly useful with bags formed from flexible thin plastic films, other types of bags may also be used in conjunction therewith. In this regard, many general merchandise stores use paper bags which do not have a generally planar bottom panel and therefore do not have the characteristic ability of the common grocery bag to freely stand in an open and upright position for convenient and efficient placement of merchandise therein.

As shown in FIG. 1, and particularly with plastic bags, integral strap-type handles 14 may be formed as a part of the bag about an open top end 15 during cutting and heat sealing fabrication processes for convenience of the shopper in carrying merchandise in the bag.

Figure 3:
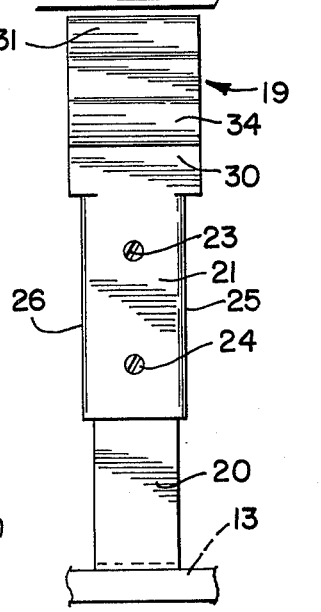
FIG. 3 is a front elevational view of the bag holding and supporting apparatus taken substantially along line 3—3 in FIG. 2.

In accordance with one aspect of the invention, bag support and holder 10 includes an upright member 17 generally extending vertically between a base 18 and a support head 19. Upright member 17 preferably includes a lower upright portion 20 formed as an integral part of base 18 and an upper upright portion 21 with support head 19 attached thereto. Upright portions 20 and 21 are further preferably in telescoping relationship to accommodate different bag heights. To this end, one of the upright portions 20 or 21, for example lower portion 20, may have at least one elongated and vertically disposed slot 22 therethrough. A threaded fastener 23, or the like, extends through an aperture 24 (FIG. 3) in upper portion 21 and through slot 22. A wing nut 24, or the like, threadedly engages fastener 23 to frictionally hold upright portions 20 and 21 in the desired vertical height when wing nut 24 is tightened.

Figure 4:
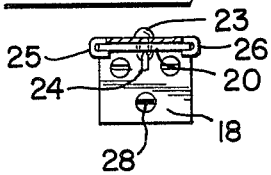
FIG. 4 is a cross sectional view of the upright member of the bag holding and supporting apparatus taken substantially along line 4—4 in FIG. 2 further illustrating the telescoping relationship of the upper and lower upright portions.

Upright portion 21 has a pair of transverse edges 25 and 26 which are rolled through 180° to define a channel, as is best seen in FIG. 4, in which generally planar upright portion 20 is slidable when wing nut 24 is loose. It will be understood, of course, that upright portions 20 and 21 could have longitudinal ribs, corrugation or the like to increase resistance to shear forces without interfering with the telescoping relationship.

Base 18 may be an integral extension of lower upright portion 20 and may be in perpendicular relationship thereto for direct mounting to horizontal surface 13, as by threaded fasteners 28. Alternatively, base 18 could be in generally planar relationship to lower upright portion 20 for mounting to a vertically disposed surface, such as a side or edge of a checkout counter.

Figure 2:
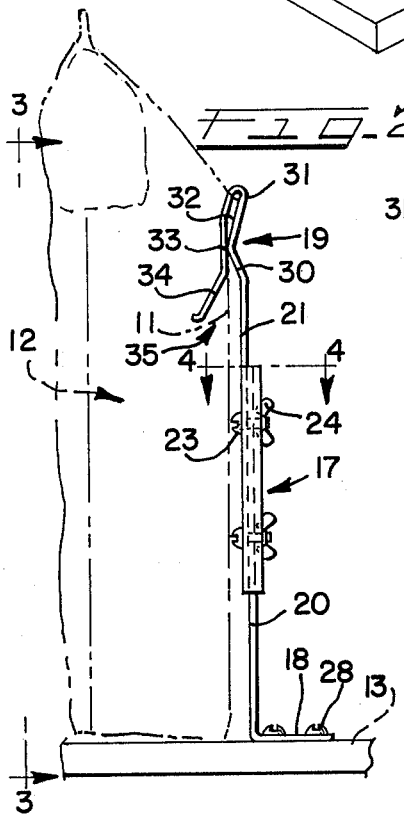
FIG. 2 is a side elevational view of the bag holding and supporting apparatus of FIG. 1.

In accordance with another aspect of the invention, support head 19 is of a modified R-shape in cross section, as is best seen in FIG. 2. Support head 19 may be formed from a continuous strip of material, such as an integral extension of upper upright portion 21 such that one leg 30 of R-shaped head 19 is an integral extension of upper upright portion 21, or is otherwise affixed thereto. An upper end 31 of support head 19 defines an eyelet 32 into which part of sidewall 11 of bag 12 may be received by sliding sidewall 11 past a line 33 of resilient contact between leg 30 and an opposing leg 34. Leg 34 preferably points outwardly away from leg 30 and upright portion 21 to define an opening 35 which converges toward contact line 33 to conveniently receive and guide part of sidewall 11 past resilient contact line 33 into eyelet 32. Resilient pressure along contact line 33 causes sidewall 11 of bag 12 to be frictionally engaged thereat. After bag 12 is filled, sidewall 11 may be conveniently removed from support and holder 10 by merely sliding sidewall 11 out of engagement support head 19. The present invention therefore permits easy and efficient insertion and removal of bag 12 from support and holder 10 by merely sliding part of sidewall 11 into or out of support head 19 without need to manipulate or otherwise actuate support head 19.

Figure 6:
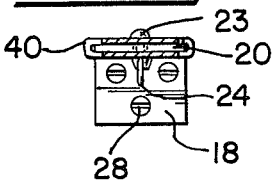
FIG. 6 is a cross sectional view of the upright portion of the apparatus of FIG. 5 taken substantially along line 6—6 further illustrating the telescoping upright member of the dual supporting head embodiment.
Figure 5:
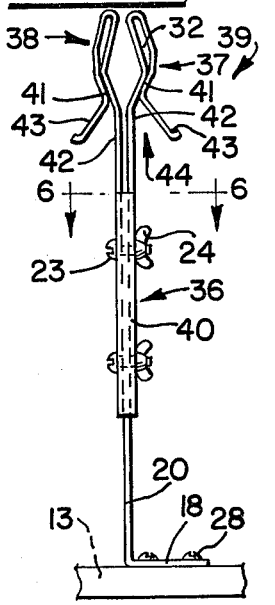
FIG. 5 is a side elevational view of another embodiment of the present invention illustrating bag holding and supporting apparatus with dual supporting heads for supporting a bag on each side of the upright member.

Shown in FIGS. 5 and 6 is another embodiment of the present invention which is similar to the preferred embodiment shown in FIGS. 1–4 except that the embodiment in FIGS. 5 and 6 has a pair of supporting heads 37 and 38 of another modified R-shape with supporting heads 37, 38 disposed in a back-to-back relationship for supporting a bag on each side of an upright member 36. Dual headed support and holder 39 may have a flattened tubular upper upright portion 40 for slidably receiving lower upright portion 20 therein, as is best illustrated in FIG. 6. Tubular upright portion 40 slidably functions in a manner similar to the channel provided by rolled edges 25, 26 of support and holder 10 shown in FIGS. 1–4 and fastener 23 in combination with wing nut 24 frictionally lock upper upright portion 40 relative to lower upright portion 20 at the desired height. Supporting head 37 is connected to one side of tubular portion 40 while supporting head 38 is connected to an opposite side thereof. Supporting heads 37, 38 are further modified from support head 19 to provide a transverse band 41 of resilient engagement between opposing legs 42 and 43 of supporting heads 37, 38. Leg 43 is similarly disposed outwardly away from leg 42 to define enlarged opening 44 which converges toward transverse band 41 to receive and guide a part of sidewall 11 of bag 12 past band 41 of resilient engagement into eyelet 32 such that bag 12 may be supported in an upright and open position without manipulation or actuation of either supporting heads 37 or 38.

While the dual head embodiment of the invention shown in FIGS. 5 and 6 may be preferred where there are at least two people or clerks for filling bags at the same time, the preferred embodiment of the invention is considered to be that shown in FIGS. 1–4 since it is anticipated that the single-headed bag support and holder 10 will ordinarily be adequate for each checkout counter. Further, the single line 33 of a resilient contact and engagement with sidewall 11 of bag 12 will provide sufficient support and holding force and does not require as much accuracy in forming the heads 37, 38 so as to get portions of legs 42, 43 in alignment to produce transverse contact band 41.

The present invention may be fabricated from a variety of materials, including sheet metal. The entire support and holder 10 or 39 may be easily fabricated in accordance with sheet metal cutting and bending fabrication techniques well known to the prior art. The support and holder 10 or 39 therefore also is economical to manufacture.

While particular embodiments of the invention have been shown and described, it will be obvious to those skilled in the art that changes and modifications may be made without departing from the invention in its broader aspects, and, therefore, the aim of the appended claims is to cover all such changes and modifications as fall within the true spirit and scope of the invention.

I claim:

1. Bag holding and supporting apparatus for holding and supporting a bag in an open and upright position while a bottom portion of said bag is resting upon a generally horizontally disposed surface, said bag holding and supporting apparatus comprising:

upright means in generally vertical orientation in relation to said generally horizontal surface, said upright means thereby defining an upper end and a lower end thereof, said upright means including a lower upright portion connected to said base means, and an upper upright portion connected to said supporting means, said lower and upper portions being in telescoping relationship to each other to change the height of said supporting means to accomodate bags of different heights, one of said upper or lower portions is generally planar in configuration and the other of said upper or lower portions if of larger transverse dimension with opposing transverse edges rolled to define a channel in which said generally planar portion is slidable, and securing means to secure said upper upright portion relative to said lower upright portion at a desired height of said supporting means in relation to said generally horizontal surface, said securing means including at least one elongated and generally vertically disposed slot in one of said upper portion or said lower porton of said upright means, and a thread fastener extending through the other of said upper or lower portions of said upright means through said slot to frictionally secure said upper portion to said lower portion at the desired telescoping position;

base means at a lower end of said upright means adapted for mounting of said bag holding and supporting apparatus in relation to said generally horizontal surface; and, supporting means disposed at the upper end of said upright means adapted to resiliently receive and engage a part of a sidewall of said bag to aid in supporting said bag in an open and upright position, said supporting means further adapted to release said resilient engagement with said bag without manipulation or actuation of said supporting means, said supporting means including a continuous piece of metal rising upwardly from said upright means and being bent back upon itself to define a generally R-shaped supporting head defining opposing sides, said opposing sides being adapted to resiliently engage a part of the sidewall of said bag therebetween, said generally R-shaped supporting head having a leg which points outwardly away from said upright means to define an enlarged opening for receiving and guiding a part of the sidewall of said bag into said supporting head for engagement therewith and said opposing sides of said supporting head defining a generally transverse line of resilient contact.

2. The bag holding and supporting apparatus as in claim 1 wherein said opposing sides of said supporting head define a generally transverse band of resilient contact.

* * * * *